United States Patent [19]

Swain et al.

[11] Patent Number: 4,756,999

[45] Date of Patent: Jul. 12, 1988

[54] PHOTOTHERMOGRAPHIC MATERIALS

[75] Inventors: Steven Swain; Ronald E. Watts, both of Bishops Stortford, England

[73] Assignee: Minnesota Mining and Manufacturing Company, St. Paul, Minn.

[21] Appl. No.: 926,646

[22] Filed: Nov. 3, 1986

[30] Foreign Application Priority Data

Nov. 20, 1985 [GB] United Kingdom ..... 8528545

[51] Int. Cl.[4] ..... G03C 1/34

[52] U.S. Cl. ..... 430/613; 430/614; 430/615; 430/619; 430/620; 430/353

[58] Field of Search ..... 430/613, 614, 615, 619, 430/620, 617, 353

[56] References Cited

U.S. PATENT DOCUMENTS

| | | | |
|---|---|---|---|
| 3,707,377 | 12/1972 | Tiers | 96/114.1 |
| 3,874,946 | 4/1975 | Costa et al. | 96/48 HD |
| 4,323,645 | 4/1982 | Hall | 430/613 |
| 4,452,885 | 6/1984 | Nozawa et al. | 430/614 |
| 4,459,350 | 7/1984 | Przezdziecki | 430/614 |
| 4,546,075 | 10/1985 | Kitaguchi et al. | 430/617 |

FOREIGN PATENT DOCUMENTS 60-257443 12/1985 Japan .

*Primary Examiner*—Won H. Louie

*Attorney, Agent, or Firm*—Donald M. Sell; Mark A. Litman

[57] ABSTRACT

A photothermographic element comprising a substrate having coated thereon a photothermographic medium comprising a binder having dispersed therein an organic silver salt or complex, a photocatalyst and a reducing agent, characterized in that the photothermographic medium contains as an antifoggant, in the absence of mercury compounds, an effective antifogging amount of a compound of the general formula:

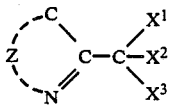

(I)

characterized in that:

$X^1$ and $X^2$ independently represent halogen atoms, $X^3$ represents a halogen atom or an electron withdrawing substituent, and Z represents the necessary atoms to complete a ring system which may comprise a single ring or a fused ring system which rings may bear substituents.

13 Claims, No Drawings

PHOTOTHERMOGRAPHIC MATERIALS

FIELD OF THE INVENTION

This invention relates to photothermographic materials of the dry silver type and in particular to antifoggants for use therein.

BACKGROUND OF THE INVENTION

Heat-developable photosensitive materials which can produce photographic images using a dry heat processing method are described, for example, in U.S. Pat. Nos. 3,152,904 and 3,457,075. These Patents disclose photothermographic elements comprising an organic silver salt, a catalytic amount of a photocatalyst, e.g. silver halide, and a reducing agent. The photothermographic materials are stable at ambient temperatures but when heated to a temperature of above 80° C., preferably 100° C. or higher, after imagewise exposure, produce silver through a redox reaction between the organic silver salt (acting as an oxidising agent) and the reducing agent. This redox reaction is accelerated by the catalytic action of the exposure generated silver catalyst. The silver which is produced by reduction of the organic silver salt in the exposed areas provides a black image to produce a contrast with respect to the unexposed areas. This results in the formation of an image.

In practice, it is essential to include an effective antifoggant in such photothermographic materials since, without an antifoggant, some generation of silver in the unexposed areas takes place upon thermal development, resulting in a poor differential between the image and background fog. In the past, the most effective antifoggant has been mercuric ion. The use of mercury compounds as antifoggants in photothermographic materials is disclosed in, for example, U.S. Pat. No. 3,589,903.

However, mercury compounds are environmentally undesirable and due to an increasing desire to remove even trace amounts of possible pollutants from commercial articles there is a demand to find equally effective but less hazardous antifoggants.

Various compounds have been suggested for use as antifoggants in place of mercury compounds in photothermographic elements.

U.S. Pat. No. 4,546,075 discloses, as antifoggants in place of mercury compounds, the use of compounds of the general formula:

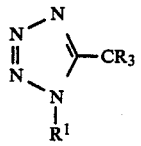

in which:

R represents a halogen atom, and $R^1$ represents hydrogen, alkyl, aryl, aralkyl, acyl, carbamoyl, alkylsulfonyl, arylsulfonyl or a heterocycle, and the use of compounds of the general formula:

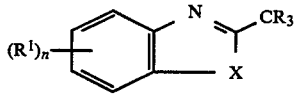

in which:

n is an integer of 1 to 4,

X represents S, O, $NR_2$,

R represents a halogen atom, and $R^1$ represents alkyl, aryl or acyl groups.

Japanese Patent Publication No. 59/57234 discloses, as antifoggants in place of mercury compounds in dry silver systems, the use of compounds of the formula:

$$R^1—CX_2—R^2$$

in which:

X represents halogen, preferably Br, and $R^1$ and $R^2$ are optionally substituted acyl, oxycarbonyl, oxysulfonyl, alkylsulfonyl, arylsulfonyl, aralkylsulfonyl, carboxy, sulfo or sulfamoyl.

U.S. Pat. No. 4,452,885 discloses, as antifoggants in place of mercury compounds, the use of compounds of the general formula:

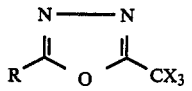

in which:

X represents a halogen atom, and

R represents hydrogen or alkyl, aryl, aralkyl, alkenyl groups or a heterocyclic residue, each of which may be substituted.

An alternative group of compounds has now been found which are effective antifoggants in photothermographic elements and provide certain advantages over the use of both mercury antifoggants and the organic antifoggants of the prior art.

SUMMARY OF THE INVENTION

According to the present invention there is provided a photothermographic element comprising a substrate having coated thereon a photothermographic medium comprising a binder having dispersed therein an organic silver salt or complex, a photocatalyst and a reducing agent, in which the photothermographic medium contains as an antifoggant, in the absence of mercury compounds, an effective amount of a compound of the general formula:

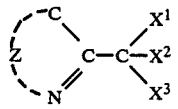

(I)

in which:

$X^1$ and $X^2$ independently represent halogen atoms, preferably bromine, $X^3$ represents a halogen atom such as bromine or chlorine, preferably bromine, or an electron withdrawing substituent, e.g. acyl, oxycarbonyl, oxysulfonyl, and Z represents the necessary atoms to complete a ring system which may comprise a single ring or a fused ring system which rings may bear substituents.

For example, Z may represent the necessary atoms selected from C, N, O and S to form (a) a 5- or 6-membered heterocyclic ring, or (b) a 5- or 6-membered heterocyclic ring as described in (a) with a fused on 5 or 6-membered ring consisting of C and N atoms with no more than two N atoms.

The ring or rings completed by Z may be substituted. Suitable substituents include alkyl and alkenyl, preferably of up to 4 carbon atoms, halogen, etc.

Preferred ring systems completed by Z include isoxazole, pyrimidine, quinoxaline, indolenine and tetraazaindene.

DETAILED DESCRIPTION OF THE INVENTION

The compounds of formula (I) have been found to be effective antifoggants in photothermographic elements as described above and when added in suitable amounts will reduce fog to the same extent as mercury antifoggants. Furthermore, many of the compounds of formula (I) provide enhanced image densities compared with mercury compounds and other known organic antifoggants for the same exposure and processing conditions. The compounds of formula (I) also markedly improve the light stability of the background after processing relative to formulations containing mercury antifoggants.

A further advantage of the use of antifoggant compounds of the invention is that the elements may be subjected to harsh drying conditions during preparation without deleteriously affecting the favourable photographic properties. For example, tests have revealed that elements containing a compound of the invention exhibit a substantially constant $D_{max}$ over a drying temperature range of 50° to 90° C. which $D_{max}$ is superior to that of elements containing known mercury and other antifoggants dried under the same conditions. Furthermore, the relative speed of the element of the invention is significantly greater than that of the comparative elements.

The optimum concentration for individual compounds of formula (I) may vary widely. Starting from the minimum amount to suppress fog, increasing amounts in some cases lead to loss of density but in other cases may produce an increase in image density before levelling out. In general, the antifoggants of formula (I) are utilised in amounts in the range $2\times10^{-3}$ to $2\times10^{-1}$ moles per mole of silver.

The antifoggants may be incorporated into the photothermographic medium in the same manner as antifoggants of the prior art. The photothermographic medium may be selected from the wide range of known formulations and in addition to the essential components recited above, the medium may contain sensitising dyes, stabilisers, toners, etc. In preferred photothermographic media the organic silver salt is silver behenate and the photocatalyst is silver halide.

Photothermographic emulsions are usually constructed as one or two layers on a substrate. Single layer constructions must contain the silver source material, the silver halide, the developer and binder as well as optional additional materials such as toners, coating aids, and other adjuvants. Two-layer constructions must contain the silver source and silver halide in one emulsion layer (usually the layer adjacent the substrate) and the other ingredients in the second layer or both layers.

The silver source material, as mentioned above, may be any material which contains a reducible source of silver ions. Silver salts of organic acids, particularly long chain (10 to 30, preferably 15 to 28 carbon atoms) fatty carboxylic acids are preferred. Complexes of organic or inorganic silver salts wherein the ligand has a gross stability constant for silver ion of between 4.0 and 10.0 are also desirable. The silver source material should constitute from about 5 to 70 and preferably from 7 to 45 percent by weight of the imaging layer. The second layer in a two-layer construction would not affect the percentage of the silver source material desired in the single imaging layer.

The silver halide may be any photosensitive silver halide such as silver bromide, silver iodide, silver chloride, silver bromoiodide, silver chlorobromoiodide, silver chlorobromide, etc., and may be added to the emulsion layer in any fashion which places it in catalytic proximity to the silver source. The silver halide is generally present as 0.75 to 15 percent by weight of the imaging layer, although larger amounts up to 20 or 25 percent are useful. It is preferred to use from 1 to 10 percent by weight silver halide in the imaging layer and most preferred to use from 1.5 to 7.0 percent.

The reducing agent for silver ion may comprise conventional photographic developers such as phenidone, hydroquinones, and catechol, and hindered phenol reducing agents may also be added. The reducing agent should be present as 1 to 10 percent by weight of the imaging layer. In a two-layer construction, if the reducing agent is in the second layer, slightly higher proportions, of from 2 to 15 percent, tend to be more desirable. Color photothermographic systems such as those disclosed in U.S. Pat. No. 4,460,681 are also contemplated in the practice of the present invention.

Toners such as phthalazinone, and both phthalazine and phthalic acid, and others known in the art, are not essential to the construction, but are highly desirable. These materials may be present, for example, in amounts of from 0.2 to 12 percent by weight.

The compounds of formula (I) may be readily prepared from the corresponding substituted heterocycles by halogenation, e.g. tribromination. The precursor compounds may be readily prepared by standard synthetic procedures well known in the art.

The following Table 1 identifies antifoggant compounds used in the Examples. Compounds 1 to 8, 13 and 14 are in accordance with the invention and Compounds 9 to 12 are antifoggants selected from the prior art.

TABLE 1

| Compound No. | Formula |
|---|---|
| 1 | 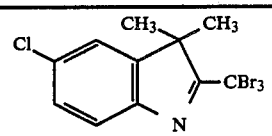 |
| 2 | 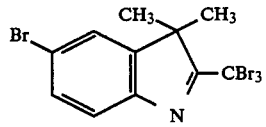 |
| 3 | 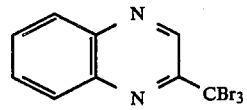 |
| 4 | 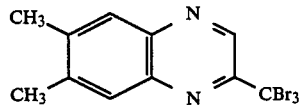 |

TABLE 1-continued

| Compound No. | Formula | |
|---|---|---|
| 5 | 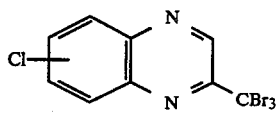 | |
| 6 | 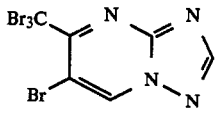 | |
| 7 | 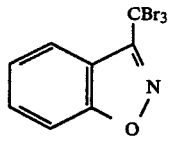 | |
| 8 | 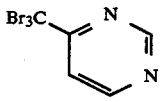 | |
| 9 | $(CH_3COO)_2Hg$ | U.S. Pat. Specification No. 3 589 903 |
| 10 | 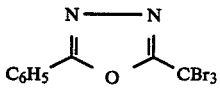 | U.S. Pat. Specification No. 4 452 885 |
| 11 | 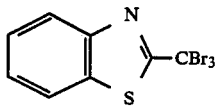 | Japanese Patent Publication No. 59 57233 |
| 12 | 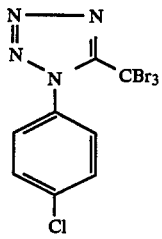 | Japanese Patent Publication No. 59 46641 |
| 13 | 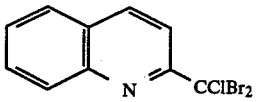 | |
| 14 | 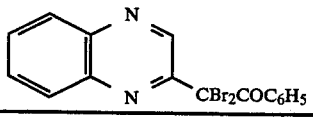 | |

Compounds 1, 4, 5, 6, 13 and 14 are believed to be novel and form a further aspect of the invention.

EXAMPLE 1

Preparation of 5-bromo-3,3-dimethyl-2-tribromomethyl indolenine (Compound No. 2)

5-Bromo-2,3,3-trimethylindolenine was synthesised by Fischer indolisation of the corresponding phenylhydrazone (see, e.g. M-F. Moreau et al, Euro. J. Med. Chem. —Chimica Therapeutica, 9, 274 (1974)). 3.57 g of 5-bromo-2,3,3-trimethylindolenine (15 mmole) and 7.38 g anhydrous sodium acetate (90 mmole) were mixed with glacial acetic acid (50 ml) and heated to 60° C. with stirring. 7.2 g of bromine (45 mmole) in glacial acetic acid (25 ml) was then added dropwise over 15 minutes and the mixture stirred at 60° C. for a further 5 minutes. The mixture was cooled and poured into 750 ml of ice/water and the precipitate collected by filtration. Recrystallisation from acetonitrile gave pale yellow crystals, 4.60 g (65%), melting at 135° C.

| | C % | H % | N % | Br % |
|---|---|---|---|---|
| Calculated | 27.82 | 1.91 | 2.95 | 67.32 |
| Found | 27.82 | 1.84 | 2.91 | |

EXAMPLE 2

A silver behenate full soap containing preformed silver halide was prepared according to the following procedure.

| (A) SILVER HALIDE PREPARATION | | |
|---|---|---|
| Solution A at 50° C. | gelatin | 25 g |
| | water (distilled) | 1500 ml pH to 4.0 with $HNO_3$ |
| | $AgNO_3$ (2.5 N) | 6 ml |
| Solution B at 50° C. | KBr | 140 g |
| | KI | 12.4 g |
| | water (distilled) | 937.5 ml |
| Solution C at 20° C. | $AgNO_3$ (2.5 N) | 400 ml |
| | water (distilled) | 350 ml |
| Solution D at 20° C. | sensitizing dye dissolved in 250 ml of methanol | |
| Solution E | 10% solution in water of an anionic surfactant sodium lauryl sulphate available under the trade name Maprofix from Millmaster-Onyx UK 150 ml. | |
| Solution F at 50° C. | water (distilled) | 100 ml |
| | gelatin | 10 g |
| | industrial methylated spirit | 50 ml |
| | NaOH 1 N | 20 ml |
| Solution G | phenol (20% solution in 1:1 ethanol:water) | 20 ml |

Solution B was pumped at a constant 50 ml/minute into Solution A and Solution C pumped at a sufficient rate to maintain the pAg constant throughout the make, the pumps for solutions B and C being started simultaneously. When the addition of Solution C was completed, the addition of Solution B was continued until the emulsion was in halide excess.

Solution D was pumped at 25 ml/minute into solution A, the pump being started 2 minutes after the start of the emulsification.

The resulting solution was cooled to 25° C. with stirring and Solution E added.

The pH was adjusted to 3.6 with 1N $H_2SO_4$. The mixture was allowed to settle and the supernatant liquid poured off. The coagulum was washed once with cold distilled water, allowed to settle and poured off and then redispersed in Solution F at 50° C. for 30 minutes.

Solution G was then added before chilling.

The spectral sensitizing dye used for this emulsion had the structure

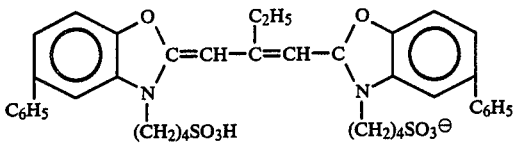

and was used at a concentration of 0.8 g/mole of silver halide. The average grain diameter of the emulsion was 0.09 micron.

(B) SOAP PREPARATION 1. 80 g behenic acid was melted in 2000 ml distilled water at 80° C. and vigorously stirred.
2. 0.05 mole of S.E.S. preformed emulsion was added. The resulting mixture was stirred for 1 minute.
3. 9.6 g NaOH in 500 ml distilled water was added and the mixture stirred for 10 minutes.
4. 0.5 ml concentrated $HNO_3$ in 5 ml of distilled water was added.
5. The mixture was cooled to 45° to 50° C. with vigorous stirring.
6. 39.5 g $AgNO_3$ in 400 ml distilled water was added slowly over 5 minutes, thereupon the thinned mixture was stirred for 10 minutes.
7. Mixture heated to 80° C. and filtered hot.
8. Solid washed twice with cold distilled water.
9. Placed in oven and dried for seven days at 32° C.

(C) HOMOGENIZATION

The dried powder was dispersed in solvents, 100 g powder in 995 ml methyl ethyl ketone and 405 ml toluene. The mixture was homogenized by passing twice through a Gaulin homogenizer.

(D) COATING

Formulation 1

A formulation was prepared by admixing the following components:

| | |
|---|---|
| Homogenate ($2 \times 10^{-3}$ mole Ag) | 10.00 g |
| Butvar B-76 (a polyvinyl butyral commercially available from Monsanto Company Ltd.) | 0.10 g |
| Antifoggant solution | 1.00 ml |
| Butvar B-76 | 0.90 g |
| Reducing agent of formula (II) | 0.07 g |

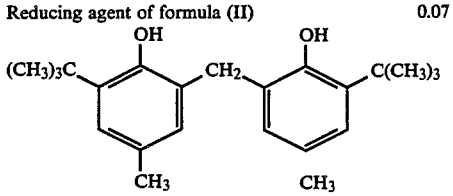

Formulation 2

A quantity of polymer solution (VYNS solution) was prepared as follows:

| | |
|---|---|
| butan-2-one | 200.0 ml |
| toluene | 95.0 ml |
| methanol | 11.0 ml |
| vinyl acetate/vinyl chloride copolymer (type VYNS commercially available | 22.0 g |

-continued

| | |
|---|---|
| from Union Carbide Corp.) | |

Formulation 2 was prepared by admixing the following components:

| | |
|---|---|
| VYNS solution | 5.00 g |
| phthalazinone | 0.02 g |
| 4-methylphthalic acid | 0.042 g |

Photothermographic elements were prepared by coating Formulation 1 on clear, unsubbed polyester base using a knife coater at a wet thickness of 0.09 mm (silver coating weight approximately 1.1 g/m$^2$) and after drying Formulation 2 was applied at a wet thickness of 0.05 mm. Formulation 1 was varied using a range of different antifoggant compounds, details of which are reported in the following Table.

| Sample | Antifoggant Compound No. | Amount (g) | Moles ($\times 10^{-5}$) | Solvent |
|---|---|---|---|---|
| A | 4 | 0.02 | 4.9 | butan-2-one |
| B | 9 | 0.006 | 1.9 | methanol |
| C | 10 | 0.02 | 5.0 | butan-2-one |
| D | 11 | 0.01 | 2.6 | butan-2-one |
| E | 12 | 0.01 | 2.3 | butan-2-one |

Strips of each material were given an exposure of $6 \times 10^4$ meter candle seconds through a 0 to 4 continuous, neutral density wedge and developed for 10 seconds on a curved metal surface at a temperature of 135° C. Photographic properties were measured using transmitted light and speeds were measured at a density of 0.1 above fog. Speed figures are stated relative to Sample B (Compound No 9) taken as 100.

| Sample | Relative Speed | Maximum Density | Fog |
|---|---|---|---|
| A | 119 | 1.20 | 0.03 |
| B | 100 | 0.90 | 0.03 |
| C | 120 | 0.90 | 0.04 |
| D | 109 | 0.85 | 0.04 |
| E | 111 | 0.85 | 0.04 |

It can be seen that the antifoggant of the present invention (Sample A) is as effective as the prior art compounds in suppressing fog and additionally gives a significantly higher image density.

EXAMPLE 3

A further series of samples was prepared as in Example 2 using different antifoggant compounds in Formulation 1. Details of the antifoggant compounds, which were employed as a solution in butan-2-one, are reported in the following Table.

| Sample | Antifoggant Compound No. | Amount (g) | Moles ($\times 10^{-5}$) |
|---|---|---|---|
| F | 1 | 0.01 | 2.3 |
| G | 2 | 0.01 | 2.1 |
| H | 3 | 0.02 | 5.3 |
| I | 5 | 0.01 | 2.4 |
| J | 6 | 0.01 | 2.2 |
| K | 7 | 0.06 | 16 |
| L | 8 | 0.003 | 0.9 |
| M | 13 | 0.05 | 14.9 |

-continued

| Sample | Antifoggant Compound No. | Amount (g) | Moles ($\times 10^{-5}$) |
|---|---|---|---|
| N | 14 | 0.05 | 12.3 |

The photographic properties of the samples were evaluated in the same manner as in Example 2 and the results are reported in the following Table.

| Sample | Relative Speed | Maximum Density | Fog |
|---|---|---|---|
| F | 118 | 1.0 | 0.02 |
| G | 117 | 1.15 | 0.02 |
| H | 111 | 1.0 | 0.03 |
| I | 121 | 1.1 | 0.03 |
| J | 118 | 1.1 | 0.03 |
| K | 117 | 0.9 | 0.04 |
| L | 127 | 0.9 | 0.03 |
| M | 135 | 1.2 | 0.07 |
| N | 120 | 0.95 | 0.04 |

The antifoggant compounds of invention are effective and all give maximum densities as good, or better, than prior art compounds.

We claim:

1. A photothermographic element comprising a substrate having coated thereon a photothermographic medium comprising a binder having dispersed therein an organic silver salt or complex, a silver halide photocatalyst and a reducing agent, wherein the photothermographic medium contains as an antifoggant, in the absence of mercury compounds, an effective antifogging amount of a compound of the general formula:

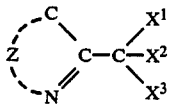

(I)

in which:

$X^1$ and $X^2$ independently represent halogen atoms, $X^3$ is selected from the group consisting of a halogen atom and an electron withdrawing substituent, and Z represents the necessary atoms to complete a ring system which may comprise a single ring or a fused ring system which rings may bear substituents.

2. An element according to claim 1, wherein $X^1$ and $X^2$ are bromine atoms.

3. An element according to claim 2, wherein $X^3$ represents a bromine atom.

4. An element according to claim 2, wherein Z represents the necessary atoms to complete a nucleus selected from isoxazole, pyrimidine, quinoxaline, indolenine and tetraazaindene.

5. An element according to claim 2, wherein the concentration of antifoggant compound of formula (I) is in the range $2\times10^{31\ 3}$ to $2\times10^{-1}$ moles per mole of silver.

6. An element according to claim 1 in which the antifoggant compound is selected from:

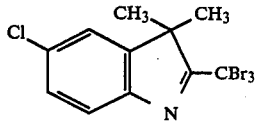

-continued

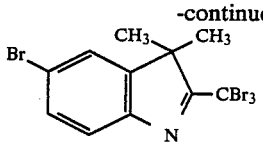

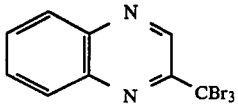

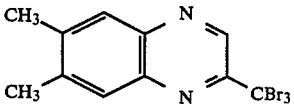

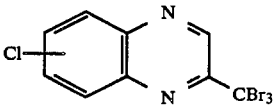

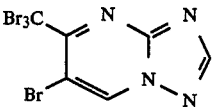

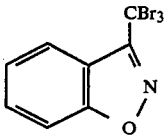

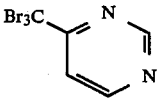

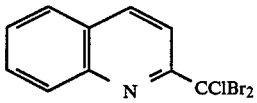

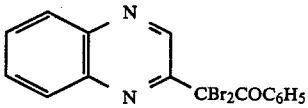

7. An element according to claim 5 in which the antifoggant compound is selected from:

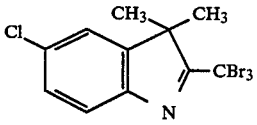

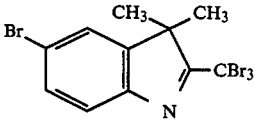

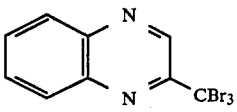

-continued

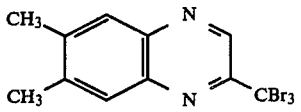

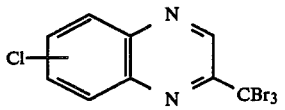

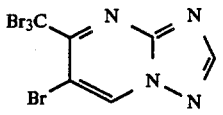

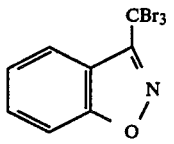

-continued

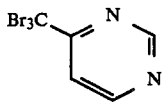

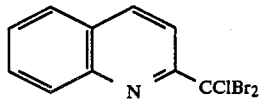

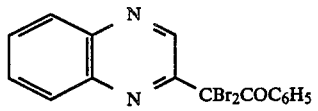

8. An element according to claim 1, wherein the organic silver salt comprises silver behenate.

9. An element according to claim 2, wherein the organic silver salt comprises silver behenate.

10. An element according to claim 3, wherein the organic silver salt comprises silver behenate.

11. An element according to claim 4, wherein the organic silver salt comprises silver behenate.

12. An element according to claim 5, wherein the organic silver salt comprises silver behenate.

13. An element according to claim 6, wherein the organic silver salt comprises silver behenate.

* * * * *